US006759366B2

(12) United States Patent
Beckerdite et al.

(10) Patent No.: US 6,759,366 B2
(45) Date of Patent: Jul. 6, 2004

(54) DUAL-SIDED IMAGING ELEMENT

(75) Inventors: Christopher H. Beckerdite, Washington Township, OH (US); John Long, West Chester, OH (US)

(73) Assignee: NCR Corporation, Dayton, OH (US)

( * ) Notice: Subject to any disclaimer, the term of this patent is extended or adjusted under 35 U.S.C. 154(b) by 51 days.

(21) Appl. No.: 10/022,923

(22) Filed: Dec. 18, 2001

(65) Prior Publication Data

US 2003/0114301 A1 Jun. 19, 2003

(51) Int. Cl.[7] ..... B41M 5/40
(52) U.S. Cl. ..... 503/200; 503/204; 503/226
(58) Field of Search ..... 503/200, 204, 503/206, 226

(56) References Cited

U.S. PATENT DOCUMENTS

| | | | | |
|---|---|---|---|---|
| 3,947,854 | A | 3/1976 | Hansen et al. | |
| 4,167,392 | A | 9/1979 | Defago | |
| RE30,116 | E | 10/1979 | Maalouf | |
| 4,507,669 | A * | 3/1985 | Sakamoto et al. | 503/207 |
| 4,708,500 | A | 11/1987 | Bangs et al. | |
| 4,956,251 | A | 9/1990 | Washizu et al. | |
| 4,965,166 | A | 10/1990 | Hosoi et al. | |
| 5,055,373 | A | 10/1991 | Saeki et al. | |
| 5,101,222 | A | 3/1992 | Hakkaku | |
| 5,196,297 | A | 3/1993 | Dombrowski, Jr. et al. | |
| 5,214,750 | A | 5/1993 | Minowa et al. | |
| 5,266,550 | A | 11/1993 | Asajima et al. | |
| 5,284,816 | A | 2/1994 | Stephenson | |
| 5,398,305 | A | 3/1995 | Yawata et al. | |
| 5,428,714 | A | 6/1995 | Yawata et al. | |
| 5,437,004 | A | 7/1995 | Miyasaka et al. | |
| 5,555,349 | A | 9/1996 | Miyasaka et al. | |
| 5,584,590 | A | 12/1996 | Ito et al. | |
| 5,594,653 | A | 1/1997 | Akiyama et al. | |
| 5,629,259 | A | 5/1997 | Akada et al. | |
| 5,639,169 | A | 6/1997 | Aruga | |
| 5,677,722 | A | 10/1997 | Park | |
| 5,692,110 | A | 11/1997 | Miyasaka et al. | |
| 5,707,925 | A | 1/1998 | Akada et al. | |
| 5,710,094 | A | 1/1998 | Minami et al. | |
| 5,755,521 | A | 5/1998 | Ito et al. | |
| 5,756,188 | A | 5/1998 | Reiter et al. | |
| 5,763,356 | A | 6/1998 | Ueno et al. | |
| 5,789,340 | A | 8/1998 | Brust et al. | |
| 5,792,725 | A | 8/1998 | Simpson et al. | |
| 5,794,530 | A | 8/1998 | Dobashi et al. | |
| 5,800,081 | A | 9/1998 | Teradaira et al. | |
| 5,815,191 | A | 9/1998 | Michielsen et al. | |
| 5,846,900 | A | 12/1998 | Reiter et al. | |
| 5,876,836 | A | 3/1999 | Imamura et al. | |
| 5,883,043 | A | 3/1999 | Halbrook, Jr. et al. | |
| 5,918,910 | A | 7/1999 | Stillwagon et al. | |
| 5,964,541 | A | 10/1999 | Murison et al. | |
| 6,095,414 | A | 8/2000 | Long et al. | |
| 6,130,185 | A | 10/2000 | Narita et al. | |
| 6,210,777 | B1 | 4/2001 | Vermeulen et al. | |
| 6,562,755 | B1 * | 5/2003 | Halbrook et al. | 503/201 |

FOREIGN PATENT DOCUMENTS

| | | |
|---|---|---|
| JP | 57-208298 | 12/1982 |

OTHER PUBLICATIONS

Abstract JP 57–208298, Watanabe Toshiyuki, published Dec. 21, 1982.

* cited by examiner

*Primary Examiner*—B. Hamilton Hess
(74) *Attorney, Agent, or Firm*—Millen, White, Zelano & Branigan, P.C.

(57) ABSTRACT

The present invention relates to an image element for dual-sided imaging. The image element may include a substrate having first and second surfaces, a first coating, and a second coating. Generally, the first coating is applied to the first surface, where the coating includes a first imaging material for creating, in situ, a first image; and the second coating is applied to the second surface, where the coating includes a second imaging material for creating, in situ, a second image.

20 Claims, 4 Drawing Sheets

DUAL-SIDED IMAGING ELEMENT

FIELD OF THE INVENTION

The invention relates to image elements, particularly dual-sided imaging elements.

BACKGROUND OF THE INVENTION

Direct thermal printers are used in many applications to provide information to a user. Often, information is provided only on one side of a paper receipt. It is desirable to be able to provide variable information on both sides of the receipt to save materials and to provide flexibility in providing information. Representative documentation in the area of dual-sided thermal printing includes the following patents:

U.S. Pat. No. 5,101,222, issued to Kunio Hakkaku on Mar. 31, 1992, discloses a thermal recording material comprising a magenta-pigment layer, a yellow-pigment layer, a cyan-pigment layer, and a polyester film (PET). The thermal recording material can be heat-processed by two opposing recording heads.

U.S. Pat. No. 4,956,251, issued to Washizu et al. on Sep. 11, 1990, discloses an apparatus that can be equipped with a double thermal head, which enables simultaneous heat recording on both sides. This patent also discloses Japanese patent application (OPI) No. 208298/82, and describes the Japanese patent as disclosing printing on both sides of an opaque support.

However, these references disclose printing with polyester film and magenta-, yellow-, and cyan- pigment layers. This is particularly a disadvantage when other materials, such as cellulosic substrates or dyes, would be more suitable for applications such as the printing of receipts. Consequently, it would be desirable to provide a dual-sided imaging element.

SUMMARY OF THE INVENTION

The present invention provides an image element for dual-sided imaging. One feature of the present invention is that the image element can include a cellulosic substrate or a lueco dye as an imaging material.

One embodiment of the present invention relates to an image element for dual-sided imaging. The image element may include a cellulosic substrate having first and second surfaces, a first coating and a second coating. The first coating may be applied to the first surface, where the coating may include a first imaging material for creating, in situ, a first image; and the second coating may be applied to the second surface, where the coating can include a second imaging material for creating, in situ, a second image.

Another embodiment of the present invention relates to an image element for dual-sided imaging. The image element can include a substrate having first and second surfaces, a first coating, and a second coating. The first coating may be applied to the first surface, where the coating can include a first lueco dye for creating, in situ, an image; and the second coating may be applied to the second surface, where the second coating can include a second lueco dye for creating, in situ, an image.

Still another embodiment of the present invention relates to an image element. The image element may include a cellulosic substrate, a first coating, and a second coating. The first coating may be applied to one surface of the cellulosic substrate and can include a first means for forming an image, in situ; and the second coating may be applied to another surface of the cellulosic substrate and can include a second means for forming an image, in situ.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
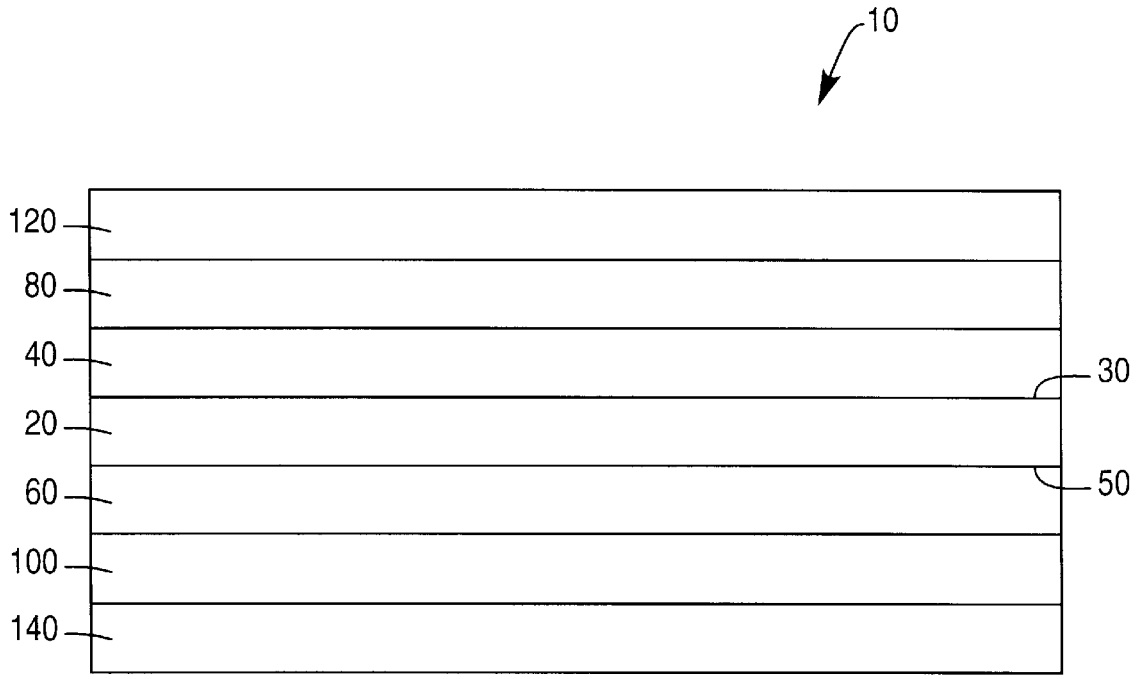
FIG. 1 illustrates a schematic cross-sectional view of an exemplary image element.

As depicted in FIG. 1, one embodiment of an image element 10 of the present invention may include a substrate 20 having a first surface 30 and a second surface 50, a first primer 40, a second primer 60, a first coating 80, a second coating 100, a first top coat 120, and a second top coat 140. Preferably, the first primer 40 is applied to the first surface 30 and the second primer 60 is applied to the second surface 50 using any suitable means such as flooding and metering, and subsequently drying. Generally, flooding with an aqueous coating mixture and then metering off the excess accomplish applying the primers. The first and second coatings 80 and 100 can be applied, respectively, to the first and second primers 40 and 60 using any suitable means such as flooding and metering, and subsequently drying. Optionally, the first and second top coats 120 and 140 can be applied, respectively, to the first and second coatings 80 and 100 using any suitable means such as flooding and metering. In another desired embodiment, an image element may omit the first and second primers 40 and 60 and the top coats 120 and 140, and merely include the first and second coatings applied directly to respective first and second surfaces of a substrate. The coatings may be applied using any suitable means, such as flooding and metering, and subsequently drying. Alternatively, spraying or dipping may be used instead of flooding and metering, with respect to applying the primers, coatings, and top coats. The image element 10 may have a basis weight of about 13 pounds (5.9 kilograms) –about 180 pounds (82 kilograms) per standard ream (500 sheets of 17" (43 cm)×22" (56 cm) paper), preferably about 13 pounds (5.9 kilograms)–about 100 pounds (45 kilograms) per standard ream, and more preferably of about 13 pounds (5.9 kilograms)–about 21 pounds (9.5 kilograms) per standard ream. Alternatively, an image element 10 having a basis weight less than 13 pounds (5.9 kilograms) may also be used. Furthermore, the image element 10 can be manufactured with any suitable process or apparatus, such as a conventional paper coating machine. Desirably, the image element 10 has a thickness less than two back-to-back conventional, i.e., one-sided printable thermal sheets.

Preferably, the substrate includes a cellulosic material, although other materials can be used such as polymers, particularly polypropylene or polyethylene, which may be in the form of films. As used herein, the term "cellulosic material" refers to a nonwoven web including cellulosic fibers (e.g., pulp) that has a structure of individual fibers which are interlaid, but not in an identifiable repeating manner. Such webs have been, in the past, formed by a variety of nonwoven manufacturing processes known to those skilled in the art such as, for example, air-forming, wet-forming and/or paper-making processes. Cellulosic material includes a carbohydrate polymer obtained from such feedstocks as seed fibers, woody fibers, bast fibers, leaf fibers, and fruit fibers.

The first and second primers 40 and 60 may be of any suitable material to facilitate the adherence of the first and second coatings to, respectively, the first and second surfaces 30 and 50 of the substrate 20. One preferred material is a water-based mixture including mainly clay materials. The water-based mixture can be spread on the substrate 20 and then dried. Desirably, the primers 40 and 60 may be used to buffer the active coatings 80 and 100 from the active residue in the substrate 20.

The first and second coatings 80 and 100 may include at least one imaging material or means for forming an image. The means for forming an image can be an imaging material. An imaging material can be at least one dye and/or pigment, and optionally, may include activating agents. One exemplary dye is a lueco dye. The coatings 80 and 100 may also further include at least one co-reactant chemical, such as a color developer, and at least one sensitizer chemical applied while suspended in a clay mixture in an aqueous form before being dried into solid form. Suitable lueco dyes, co-reactant chemicals, and sensitizers can be those disclosed in U.S. Pat. No. 5,883,043 issued Mar. 16, 1999; hereby incorporated by reference. To prevent the blurring of images, the first coating 80 may have a dye and/or co-reactant chemical activated at a different temperature than the dye and/or co-reactant chemical present in the second coating 100. Alternatively, the substrate 20 may have sufficient thermal resistance to prevent the heat applied to one coating to activate the dye and/or co-reactant chemical in the other coating. Thus, both coatings 80 and 100 may activate at the same temperature. Generally, the coatings 80 and 100 are less than 0.001 inch ($2.54\times10^{-5}$ meter) thick.

The topcoats 120 and 140 may include any suitable components that serve to enhance certain performance properties of the element 10. The composition of the topcoatings can vary widely to enhance various properties of the element 10, and such compositions are known to those of skill in the art. Alternatively, one of the topcoats 120 and 140 may be a backcoat provided the backcoat does not interfere with the imaging properties of the element 10. The backcoat may be applied as a water spray that includes static or abrasion reducing additives.

Figure 2:
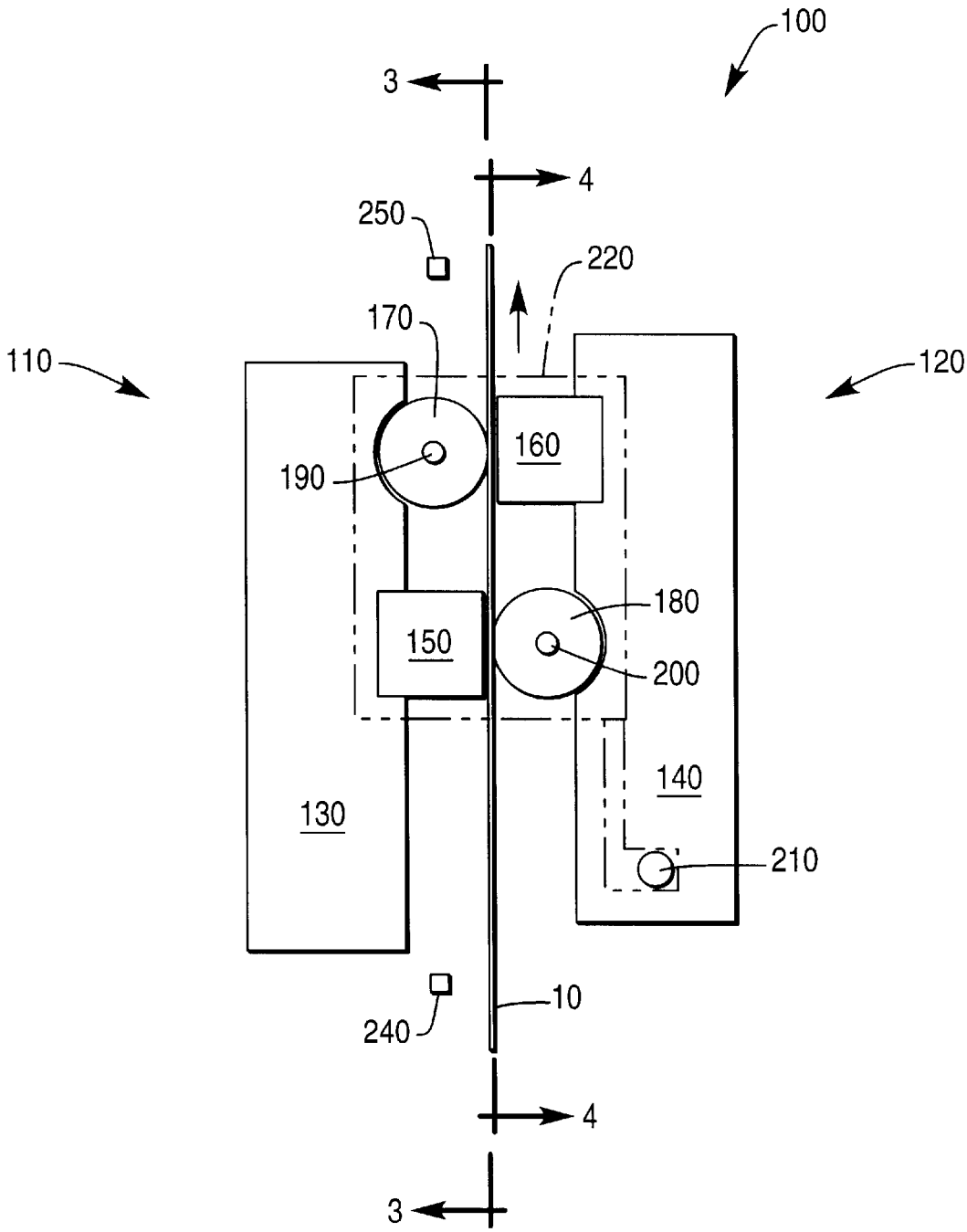
FIG. 2 illustrates a schematic, top view of an exemplary dual-sided imaging direct thermal printer with a drive assembly depicted in phantom lines.
Figure 3:
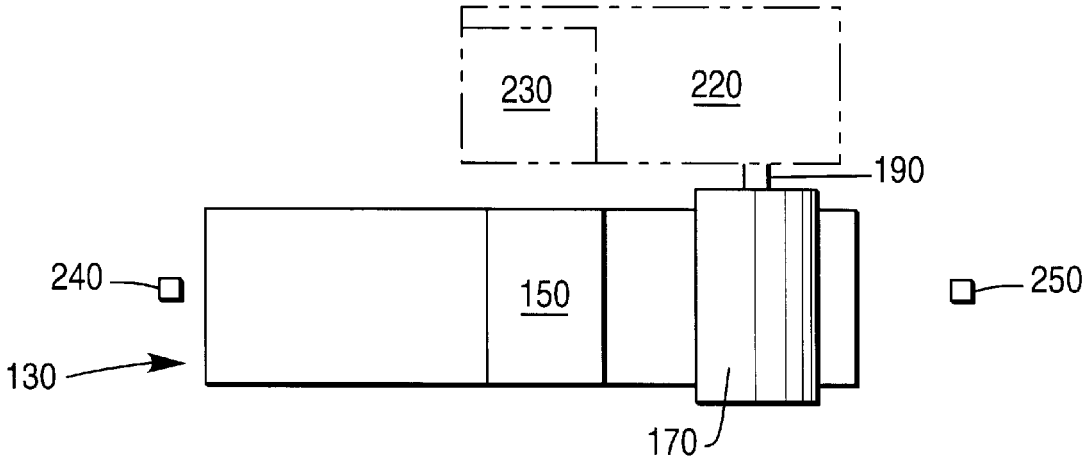
FIG. 3 illustrates a schematic of a cross-sectional view along lines 2—2 of FIG. 2 of the exemplary dual-sided imaging direct thermal printer.
Figure 4:
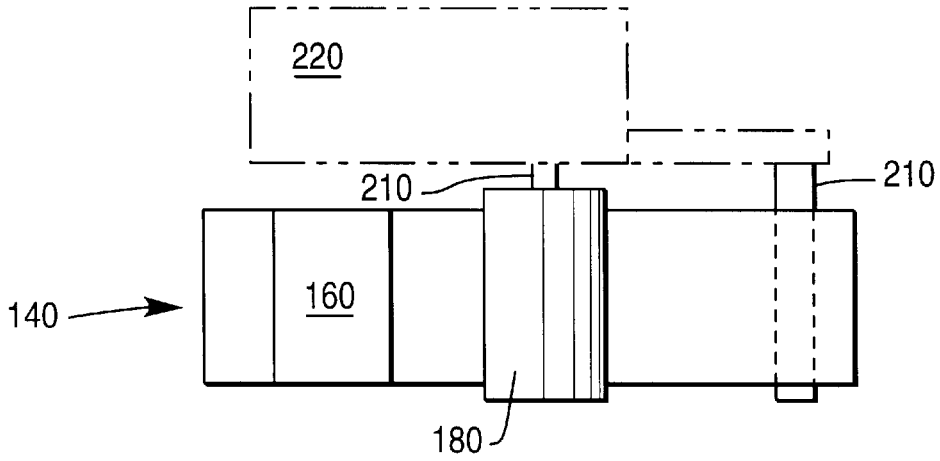
FIG. 4 illustrates a schematic of a cross-sectional view along lines 3—3 of FIG. 2 of the exemplary dual-sided imaging direct thermal printer.
Figure 5:
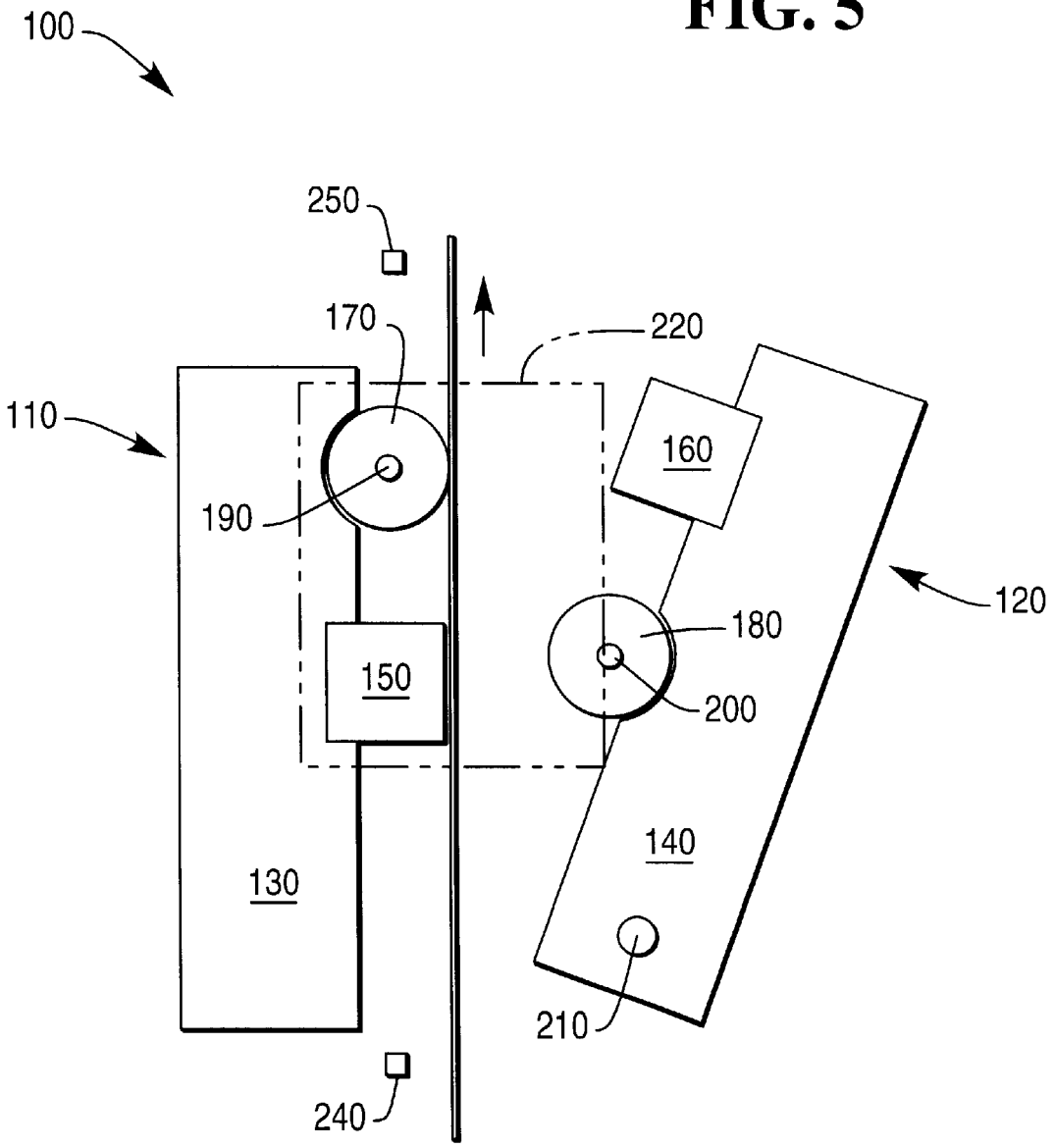
FIG. 5 illustrates a schematic, top view of the exemplary dual-sided imaging direct thermal printer depicting a second arm 140 in a rotated position away from a first arm 130.

The image element 10 is preferably printed in a suitable dual-sided imaging direct thermal printer as described herein. One preferred dual-sided imaging direct thermal printer 100 is depicted in FIGS. 2–4. The direct thermal printer 100 may include a first print head assembly 110, a second print head assembly 120, a drive assembly 220, a motor 230, and optionally, sensors 240 and 250.

The first print head assembly 110 may further include a first arm 130, a first printhead 150, and a first platen 170. The first arm 130 may be formed integrally with, or coupled to, the first printhead 150. The first printhead 150 may be any printhead suitable for direct thermal printing, such as those disclosed in U.S. Pat. No. 3,947,854 issued Mar. 30, 1976; U.S. Pat. No. 4,708,500 issued Nov. 24, 1987; and U.S. Pat. No. 5,964,541 issued Oct. 12, 1999. The first platen 170 may be substantially cylindrical in shape and journaled on a first shaft 190, which may, in turn, be coupled to the first arm 130. Preferably, the first platen 170 is rotatable about the shaft 190 for feeding an image element 10 through the printer 100.

The second print head assembly 120 may further include a second arm 140, a second printhead 160, and a second platen 180. The second arm 140 may be formed integrally with, or coupled to, the second printhead 160. In addition, the second arm 140 can be journaled on an arm shaft 210 to permit the rotation of the arm 140. In another embodiment, the first and second arms 130 and 140 are in a fixed relation. The second printhead 160 may be any printhead suitable for direct thermal printing, such as those disclosed in U.S. Pat. Nos. 3,947,854; 4,708,500; and 5,964,541. The second platen 180 may be substantially cylindrical in shape and journaled on a second shaft 200, which may, in turn, be coupled to the second arm 140. Preferably, the second platen 180, in coordination with the first platen 170, is rotatable about the shaft 200 for feeding an image element 10 through the printer 100.

A drive assembly 220 communicates with the shafts 190, 200, and 210 for rotating the platens 170 and 180, if desired, three hundred and sixty degrees; and the second arm 140, if desired, up to 170 degrees away from the first arm 130. The drive assembly 220 may be a system of gears, links, cams, or combinations thereof. The drive assembly 220, in turn, communicates with a motor 230 as depicted in FIG. 3, which is preferably electric.

The printer 100 may, optionally, include sensors 240 and 250. The sensor 240 can detect the characteristics of the image element 10 and the sensor 250 may detect image quality. In addition, another set of sensors may be placed in an opposed relation to sensors 240 and 250 on the opposite side of image element 10.

In operation, the image element 10 is fed into the printer 100 by operating the motor 230 to rotate the second arm 140 away from the first arm 130 in the position as depicted in FIG. 4. Once the image element 10 is inserted past the platens 150 and 160, the arm 140 is pivoted back to the position depicted in FIG. 1. This position of the second arm 140 pinches the image element 10 between the first printhead 150 and second platen 180, and the second printhead 160 and the first platen 170.

Next, the motor is operated to rotate the platens 170 and 180, which feeds the image element 10 past the sensor 250 as indicated by the arrow depicted in FIG. 1. As the image element passes between the first printhead 150 and the second platen 180, activating the printhead 150 will transfer heat from the printhead 150 to the image element 10, resulting in the activation of the imaging material in one of the coatings, e.g. first coating 80. Once activated, the desired image will form on that coating side. The heat transfer resistance of the substrate, and/or the lower activation temperature of the imaging material with respect to the activation temperature of the imaging material in the other coating prevents an image from forming on the other side of the image element 10. Next, the image element proceeds between the printhead 160 and the platen 170 where a second image may be created on the side of image element 10 opposed to the first image. Although this image may be a mirror image of the first image to present one amplified image, desirably this second image is different from the first image to provide additional data to a user. Activating the printhead 160 will transfer heat from the printhead 160 to the image element 10, resulting in the activation of the imaging material in the other coating, e.g. second coating 100. Once activated, the desired image will form on that coating side. Generally, the initial activation temperature is 150° F. (66° C.)–189° F. (87° C.), and preferably 158° F. (70° C.)–165° F. (74° C.), and the image development temperature (or optimum activation temperature) is 176° F. (80° C.)–302° F. (150° C.), preferably 190° F. (88° C.)–239° F. (115° C.), and optimally 190° F. (88° C.)–212° F. (100° C.). The initial activation temperature is the temperature where some chemical transformation begins in the first and second coatings 80 and 100, but not enough transformation occurs to render the image complete, acceptable, or legible. The image development temperature (or optimum activation temperature) is the temperature where the majority of the active ingredients have chemically reacted; e.g., the majority of the lueco dyes have changed from colorless to black.

The heat transfer resistance of the substrate, and/or the higher activation temperature of the imaging material with respect to the activation temperature of the imaging material in the other coating can prevent a premature image from forming when heating element 150 was activated. This arrangement of the printheads 150 and 160 and platens 170 and 180 can permit the substantially simultaneous printing of dual images while providing time for the first image to cure and the first side to cool prior to proceeding with the second image. Once printed, the image element 10 passes past the sensor 250 for recovery by a user.

Without further elaboration, it is believed that one skilled in the art can, using the preceding description, utilize the present invention to its fullest extent.

The entire disclosures of all applications, patents and publications, cited herein, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An image element for dual-sided imaging, comprising:

a cellulosic substrate comprising first and second surfaces and having sufficient thermal resistance to prevent heat applied to one coating to activate a color change in the other coating;

a first coating applied to the first surface, wherein the coating comprises a first imaging material for creating, in situ, a first image; and a second coating applied to the second surface, wherein the coating comprises a second imaging material for creating, in situ, a second image.

2. An image element according to claim 1, further comprising a first primer between the first surface and the first coating and a second primer between the second surface and the second coating.

3. An image element according to claim 2 wherein the first and second primers comprise a water and clay mixture.

4. An image element according to claim 1 wherein the first and second coatings comprise an aqueous mixture of a lueco dye, a co-reactant chemical, and a sensitizer chemical.

5. An image element according to claim 1 wherein the image element has a basis weight of 13 pounds–180 pounds per standard ream.

6. An image element according to claim 1 wherein the first or second imaging material is a lueco dye.

7. An image element according to claim 1, further comprising a first and second top coat wherein the first top coat is applied to the first coating and the second top coat is applied to the second coating.

8. An image element according to claim 1, wherein the image element is a thermal image element.

9. An image element according to claim 1, wherein the first imaging material activates at a different temperature than the second imaging material.

10. An image element according to claim 1, wherein the first imaging material activates at substantially the same temperature as the second imaging material.

11. An image element for dual-sided imaging, comprising:

a substrate comprising first and second surfaces having sufficient thermal resistance to prevent heat applied to one coating to activate a color change in the other coating;

a first coating applied to the first surface, wherein the coating comprises a first lueco dye for creating, in situ, an image; and a second coating applied to the second surface, wherein the coating comprises a second lueco dye for creating, in situ, an image.

12. An image element according to claim 11 wherein the substrate is a cellulosic or polymer substrate.

13. An image element according to claim 11 wherein the image element has a basis weight of 13 pounds–180 pounds per standard ream.

14. An image element according to claim 11, further comprising a first primer between the first surface and the first coating and a second primer between the second surface and the second coating.

15. An image element according to claim 14 wherein the first and second primers comprise a water and clay mixture.

16. An image element according to claim 11, further comprising a first and second top coat wherein the first top coat is applied to the first coating and the second top coat is applied to the second coating.

17. An image element, comprising:

a cellulosic substrate having sufficient thermal resistance to prevent heat applied to one coating to activate a color change in the other coating;

a first coating, applied to one surface of the cellulosic substrate, comprising a first means for forming an image, in situ; and a second coating, applied to another surface of the cellulosic substrate, comprising a second means for forming an image, in situ.

18. An image element according to claim 17, wherein the first and second means for forming an image are an imaging material.

19. An image element according to claim 17, wherein the first and second means for forming an image are a lueco dye.

20. An image element for dual-sided imaging, comprising:

a substrate comprising first and second surfaces;

a first coating applied to the first surface, wherein the coating comprises a first lueco dye for creating, in situ, an image; and a second coating applied to the second surface, wherein the coating comprises a second lueco dye for creating, in situ, an image, wherein the first imaging material activates at a different temperature as the second imaging material.

* * * * *